US006339393B1

(12) United States Patent
Burnside et al.

(10) Patent No.: US 6,339,393 B1
(45) Date of Patent: Jan. 15, 2002

(54) ROLLED EDGE COMPACT RANGE REFLECTORS

(75) Inventors: Walter D. Burnside; David Steinberger, both of Columbus; Teh-Hong Lee, Dublin; Kevin Sickles, Sunbury, all of OH (US)

(73) Assignee: The Ohio State University, Columbus, OH (US)

( * ) Notice: Subject to any disclaimer, the term of this patent is extended or adjusted under 35 U.S.C. 154(b) by 0 days.

(21) Appl. No.: 09/619,830

(22) Filed: Jul. 20, 2000

(51) Int. Cl.[7] ..... H01Q 15/14
(52) U.S. Cl. ..... 342/5
(58) Field of Search ..... 342/5, 7, 8, 10

(56) References Cited

U.S. PATENT DOCUMENTS

| | | | | | |
|---|---|---|---|---|---|
| 3,700,882 | A | * | 10/1972 | Planchon | 362/298 |
| H000514 | H | * | 8/1988 | Burnside et al. | 342/360 |
| 5,270,726 | A | | 12/1993 | Axtell et al. | 343/912 |
| 5,298,911 | A | * | 3/1994 | Li | 343/912 |
| 5,341,150 | A | * | 8/1994 | Joy | 343/912 |
| 5,954,421 | A | * | 9/1999 | McGrath | 362/222 |

OTHER PUBLICATIONS

"A serrated edge Gregorian subreflector for dual chamber compact range system", Gupta, I.J.; Brown, D.G.; Burnside, W.D.; Lin, W., Antennas and Propagation, IEEE Transactions on, vol. 39 Issue: 8, Aug. 1991, pp. 1258–1261.*

"Compact range measurement systems for electrically small test zones", Gupta, I.J.; Burnside, W.D., Antennas and Propagation, IEEE Transactions on, vol. 39 Issue: 5, May 1991, pp: 632–638.*

"Evaluation of compact range using a diagonal flat plate", Lee, T.–H.; Burnside, W.D., Antennas and Propagation Society International Symposium, 1991. AP–S. Digest, 1991, pp.1174–1177 vol. 2.*

"Feed and subreflector alignment in a Gregorian compact range (radar)", Vedeler, E., Southeastcon '91., IEEE Proceedings of, 1991, pp. 1–3 vol. 1.*

"Analysis of blended rolled edge reflectors using numerial UTD", Ellingson, S.W.; Gupta, I.J.; Burnside, W.D., Antennas and Propagation, IEEE Transactions on, vol. 38 Issue: 12, Dec. 1990, pp. 1969–1971.*

T.–H. Lee and W.D. Burnside, "Performance Trade–Off Between Serrated Edge and Blended Rolled Edge Compact Range Reflectors," *IEEE Trans. Antennas Propagat., AP–44*(1), 87–96, (Jan. 1996).

T.–H. Lee and W.D. Burnside, "Compact Range Reflector Edge Treatment Impact on Antenna and Scattering Measurements," *IEEE Trans. Antennas Propagat., AP–45*(1), 57–65, (Jan. 1997).

W.D. Burnside, M.C. Gilreath, B. Kent, and G. Clerici, "Curved Edge Modification of Compact Range Reflector," *IEEE Trans. Antennas Propagat., AP–35*(2), 176–182, (Feb. 1987).

I.J. Gupta, K.P. Erickson and W.D. Burnside, "A Method to Design Blended Rolled Edges for Compact Range Reflectors," *IEEE Trans. Antennas Propagat., AP–38*(6), 853–861, (Jun. 1990).

* cited by examiner

*Primary Examiner*—John B. Sotomayor
(74) *Attorney, Agent, or Firm*—Standley & Gilcrest LLP

(57) ABSTRACT

The present invention includes rolled edge compact range reflectors and reflector systems. This invention also includes machines or electronic apparatus using these aspects of the invention. The present invention also includes methods and processes for making and using these devices and systems. In a preferred embodiment, lightweight foam panels are added to the periphery of a sharp edge terminated compact range reflector. These foam panels may be shaped using simple two-dimensional cutting apparatus. The foam panels are then preferably positioned around the edge of the reflector with the planar edges of the foam pieces abutting one another so as to form a substantially continuous rounded edge to the reflector. The edge may then be shaped, filled, sanded, or coated to improve performance of the resultant reflector.

14 Claims, 1 Drawing Sheet

ROLLED EDGE COMPACT RANGE REFLECTORS

TECHNICAL FIELD OF THE INVENTION

The present invention is in the field of compact ranges and compact range reflectors.

BACKGROUND OF THE INVENTION

This invention relates to methods and apparatus useful in electromagnetic testing and measurement. More specifically, this invention relates to rolled edge reflectors useful in compact ranges.

Compact ranges are useful in limited space settings for applications such as testing radar cross-sections of objects and measuring antenna patterns. As conventional outdoor ranges require a significant amount of unobstructed space between the illuminating source and the object illuminated by that source, these compact ranges can offer significant cost savings. Compact ranges also offer the possibility of enclosed testing, allowing better control over the testing conditions than the outdoor ranges.

In typical applications, a target or antenna is placed a distance many wavelengths away from the source, so that the test object is illuminated by a plane wave. This is a condition known as the "far field". Similarly, antennae typically illuminate objects that are many wavelengths away, so as to be in the far field of the antenna. When measuring target cross-sections or antenna patterns, far field conditions must be replicated to the extent possible.

Compact ranges also need to produce a plane wave throughout the volume of space occupied by the target. This target zone, also known as the quiet zone, needs to be as uncontaminated by spurious electromagnetic energy as possible.

Compact ranges are often constructed using a parabolic reflector, which is illuminated by a source at the reflector's focus. Unfortunately, diffraction from the edge of the reflector often distorts the otherwise plane waves and contaminates the target zone. It is therefore desirable to develop a reflector that appears to have no diffracting edge within the operational electromagnetic spectrum.

Rolled edge reflectors are thought to provide the best performance for compact range applications. The rolled edge concept has not been used in many applications, however, because it is generally too expensive. It has not been uncommon to see a rolled edge reflector cost twice as much as a serrated edge, compact range reflector.

The rolled edges to date have been constructed using three-dimensional milling concepts. The basic rolled edge pieces have been set up on large rigid support structures and then milled into the three-dimensional shapes. This process is very expensive and time consuming, which leads to the large additional cost.

It is therefore an object of the present invention to develop an inexpensive method of producing a rolled edge compact range reflector.

Although described with respect to the field of compact ranges, it will be appreciated that similar advantages may be obtained in other applications of the present invention. Such advantages may become apparent to one of ordinary skill in the art in light of the present disclosure or through practice of the invention.

SUMMARY OF THE INVENTION

The present invention includes rolled edge compact range reflectors. This invention also includes machines or electronic apparatus using these aspects of the invention. The present invention may also be used to upgrade, repair or retrofit existing machines or electronic devices or instruments of these types, using methods and components used in the art. The present invention also includes methods and processes for making and using these devices.

The rolled-edge compact range reflector of the present invention comprises a compact range reflector. The compact range reflector typically has sharp edge termination. The invention also comprises several planar members. Each planar member has a rounded outer edge and an inner edge that is shaped so as to substantially conform to a position along the irregular edge of the reflector. The inner edge of each member is positioned along the irregular edge of the reflector so as to form a substantially continuous rounded outer edge.

The compact range reflector may additionally comprise a support structure adapted to maintain the position of the reflector. Each of the planar members may then be bonded to the support structure. The planar members may be of any appropriate material, preferably something thin and lightweight such as one pound per cubic foot foam panels. Each planar member may have a wedge-shaped profile, being thicker at the rounded outer edge than at the shaped inner edge. The reflector may also have protective or reflective coatings applied to improve durability and performance. These coatings may be any appropriate coatings known in the art.

Also included in the present invention is a method for adding a rolled edge to a compact range reflector. A planar member of an appropriate material is obtained. A rounded edge is formed on the planar member, such as by cutting with a two-dimensional saw or hot wire. The non-rounded edge of the planar member is then shaped to substantially conform to a position along the outer edge of the compact range reflector. Here, the position for the member along the edge of the reflector is located, and the profile at that position measured. A corresponding shape is then formed in the non-rounded edge. Each planar member is then attached to the compact range reflector and any adjacent planar members, so as to form a substantially continuous rounded outer edge to the compact range reflector.

The method may additionally comprise the step of forming a wedge profile to each planar member, the rounded edge being thicker than the non-rounded edge. This may provide greater continuity to the resultant rounded edge. The rounded edge of each planar member may also be tapered, so that when placed between two adjacent members the resultant outer surface is substantially smooth, instead of jagged or serrated. Any openings or gaps between the adjacent planar members may be filled with any appropriate filler material known in the art. The outer edge of the planar members may also be sanded to improve the continuity of the rolled edge surface in all directions. A protective coating may be applied to the planar members to increase overall durability. A reflective coating may also be applied to improve the performance of the resultant reflector.

DETAILED DESCRIPTION OF THE PREFERRED EMBODIMENT(S)

In accordance with the foregoing summary, the following presents a detailed description of the preferred embodiment of the invention that is currently considered to be the best mode.

To overcome the cost associated with current rolled edge reflectors, a preferred embodiment of the present invention utilizes flat or nearly flat pieces of foam to build the rolled edges. These foam pieces may be cut using a two-dimensional cutting device. The cutting device may be any appropriate device for cutting two-dimensional pieces, such as a saw or hot wire, and may be either manually or computer controlled.

Figure 1:
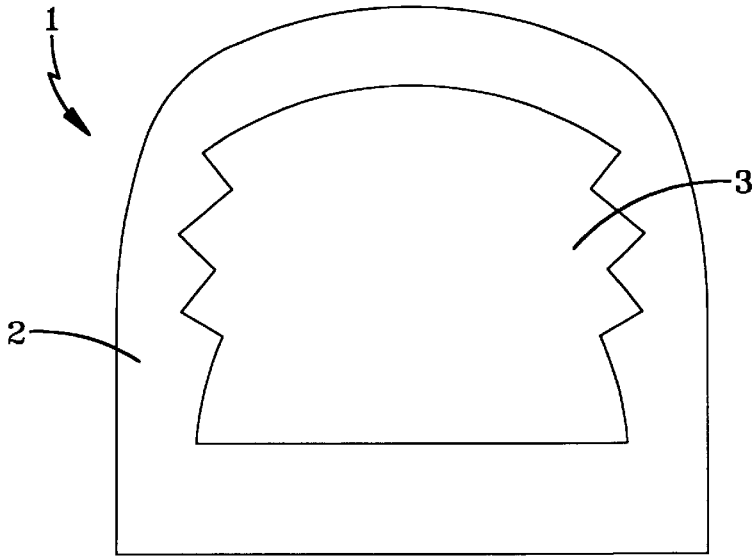
FIG. 1 is a front view of a rolled edge compact range reflector of the present invention.

The compact range reflectors that presently exist tend to have significant backup structures to insure the surface quality of the main central reflecting surfaces. Rolled edges can be easily added to these structures with no added support structure needed. FIG. 1 shows a resultant rolled edge reflector 1. Lightweight foam pieces 2 are added to the periphery of the serrated edge reflector 3. The planar edges of the foam pieces 2 abut one another so as to form a substantially continuous surface around the resultant reflector 1.

Each of the foam panels may be easy to cut to match a radial cut contour, and easy to install. The foam panels may be finished so as to mate with the precise edge found on adjacent panels. Since the panels are preferably thin, such as two to six inches thick, jumps or jaggedness in the rolled edge surface will be rather small, and should be easy to finish away by either sanding or filling. Once the edge is preferably properly finished, sanded, and filled, the edge will appear to be continuous, smooth, and rounded. The finished surface may preferably then have a protective coating applied to its surface. A reflective coating may also be applied to provide the needed electrical performance. It is possible, however, to use the unfinished surface if it is electromagnetically reflective.

Figure 2:
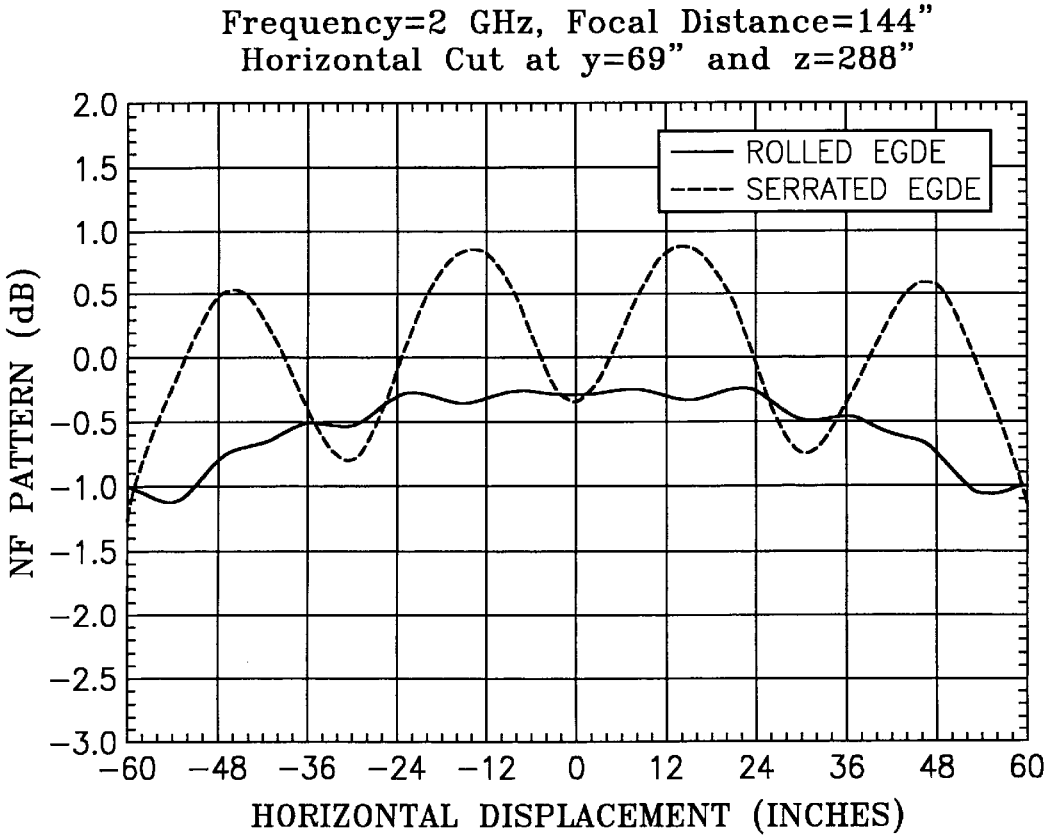
FIG. 2 is a graphical comparison of field signals in accordance with the present invention.

A graphical comparison of the foam panel rolled edge reflector and a serrated edge reflector is shown in FIG. 2. Notice that the field signal at this frequency is substantially more uniform for the rolled edge reflector.

The foam panels are preferably bonded to the existing support structure and aligned with the parabolic section of the reflector. It is preferred that the panels are aligned and bonded one at a time for optimum performance. The preferred foam panels are so light that they can be used to easily support each other. Since the foam is easy to cut two-dimensionally, it may be cut on site to meet the actual measured dimensions. Since the foam panels will actually be radial slices of the rolled edge structure, they may be cut at a slight wedge angle to improve continuity of the edge. This simple cut may also be done on site just prior to installation.

The simplicity of this approach allows the foam rolled edge pieces to be cut and installed in a few days. This means that the installation costs can be greatly reduced compared to current rolled edge methods. A two-dimensional foam cutting machine is typically simple to construct because it only needs to cut a contour out of a flat or nearly flat panel. This makes the whole process very cost effective.

The preferred embodiments herein disclosed are not intended to be exhaustive or to unnecessarily limit the scope of the invention. The preferred embodiments were chosen and described in order to explain the principles of the present invention so that others skilled in the art may practice the invention. Having shown and described preferred embodiments of the present invention, it will be within the ability of one of ordinary skill in the art to make alterations or modifications to the present invention, such as through the substitution of equivalent materials or structural arrangements, or through the use of equivalent process steps, so as to be able to practice the present invention without departing from its spirit as reflected in the appended claims, the text and teaching of which are hereby incorporated by reference herein. It is the intention, therefore, to limit the invention only as indicated by the scope of the claims and equivalents thereof.

REFERENCES

1. T.-H. Lee and W. D. Burnside, "Performance Trade-Off Between Serrated Edge and Blended Rolled Edge Compact Range Reflectors," *IEEE Trans. Antennas Propagat., AP*-44(1), 87–96, (January 1996).
2. T.-H. Lee and W. D. Burnside, "Compact Range Reflector Edge Treatment Impact on Antenna and Scattering Measurements," *IEEE Trans. Antennas Propagat., AP*-45 (1), 57–65, (January 1997).
3. W. D. Burnside, M. C. Gilreath, B. Kent, and G. Clerici, "Curved Edge Modification of Compact Range Reflector," *IEEE Trans. Antennas Propagat., AP*-35(2), 176–182, (February 1987).
4. I. J. Gupta, K. P. Erickson and W. D. Burnside, "A Method to Design Blended Rolled Edges for Compact Range Reflectors," *IEEE Trans. Antennas Propagat., AP*-38(6), 853–861, (June 1990).

The above references are hereby incorporated herein.

What is claimed is:

1. A rolled-edge compact range reflector comprising:

(a) a compact range reflector, said compact range reflector having a terminating edge; and (b) a plurality of planar members, each of said planar members having a rounded outer edge and an inner edge shaped to substantially conform to a position along said terminating edge of said compact range reflector, said inner edge of each of said plurality of planar members positioned along said compact range reflector so as to form a substantially continuous rounded outer edge around said compact range reflector.

2. A rolled-edge compact range reflector according to claim 1 additionally comprising a support structure, said support structure adapted to maintain the position of said compact range reflector.

3. A rolled-edge compact range reflector according to claim 2 wherein each of said plurality of planar members is bonded to said support structure.

4. A rolled-edge compact range reflector according to claim 1 wherein said plurality of planar members comprise thin, lightweight materials such as foam panels.

5. A rolled-edge compact range reflector according to claim 1 wherein each of said plurality of planar members has a wedge-shaped profile, each of said planar members being thicker at said rounded outer edge than at said shaped inner edge.

6. A rolled-edge compact range reflector according to claim 1 additionally comprising a protective coating applied to said plurality of planar members.

7. A rolled-edge compact range reflector according to claim 1 additionally comprising a reflective coating applied to said reflector and said planar members.

8. A method for adding a rolled edge to a compact range reflector, said method comprising the steps of:

(a) forming a rounded edge to a planar member;

(b) forming a shape in a non-rounded edge of said planar member, said shape adapted to substantially conform to a position along the outer edge of said compact range reflector; and (c) attaching said planar member to said compact range reflector and any adjacent planar members so as to form a substantially continuous rounded outer edge to said compact range reflector.

9. A method according to claim 8 additionally comprising the step of forming a wedge profile to each said planar member, said rounded edge being thicker than said non-rounded edge.

10. A method according to claim 8 additionally comprising the step of tapering the rounded edge of each said planar member.

11. A method according to claim 8 additionally comprising the step of filling any openings between said adjacent planar members with a filler material.

12. A method according to claim 8 additionally comprising the step of sanding said adjacent planar members.

13. A method according to claim 8 additionally comprising the step of applying a protective coating to said planar members.

14. A method according to claim 8 additionally comprising the step of applying a reflective coating to said compact range reflector and said planar members.

* * * * *